US007520718B2

(12) United States Patent
Engle

(10) Patent No.: US 7,520,718 B2
(45) Date of Patent: Apr. 21, 2009

(54) SEAL AND LOCKING PLATE FOR TURBINE ROTOR ASSEMBLY BETWEEN TURBINE BLADE AND TURBINE VANE

(75) Inventor: Darren T. Engle, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 526 days.

(21) Appl. No.: 11/183,708

(22) Filed: Jul. 18, 2005

(65) Prior Publication Data

US 2007/0014668 A1 Jan. 18, 2007

(51) Int. Cl.
*F01D 11/02* (2006.01)
*F01D 5/32* (2006.01)

(52) U.S. Cl. ..... 415/173.7; 416/96 R; 416/198 A; 416/220 R

(58) Field of Classification Search ..... 415/115–116, 415/173.7, 174.4, 174.5; 416/95, 96 R, 96 A, 416/97 R, 198 A, 200 A, 201 R, 220 R, 221
See application file for complete search history.

(56) References Cited

U.S. PATENT DOCUMENTS 3,768,924 A 10/1973 Corsmeier et al.
4,470,757 A * 9/1984 Vollinger ..... 416/221
4,645,424 A 2/1987 Peters
4,668,167 A 5/1987 Le Maout et al.
4,820,119 A 4/1989 Joyce
5,236,302 A 8/1993 Weisgerber et al.
5,318,405 A 6/1994 Meade et al.
5,338,154 A 8/1994 Meade et al.
6,416,246 B1 7/2002 Boeck
6,464,453 B2 10/2002 Toborg et al.
6,499,945 B1 12/2002 Lathrop
6,558,118 B1 5/2003 Brisson et al.
6,811,374 B2 11/2004 Brisson et al.
7,052,240 B2 * 5/2006 Race et al. ..... 416/198 A
2003/0082049 A1 5/2003 Brisson et al.

FOREIGN PATENT DOCUMENTS

JP 43-17121 A * 4/1968 ..... 416/198 A

* cited by examiner

*Primary Examiner*—Christopher Verdier

(57) ABSTRACT

A seal plate system adapted to fit between axially adjacent turbine blades and turbine vanes is disclosed. The seal plate system may be formed from a plate adapted to position a turbine blade in a rotor assembly and lock the turbine blade into the rotor assembly. The plate may also function to seal a cooling system in the turbine blade. In at least one embodiment, the plate may be configured to accomplish both of these tasks together once installed into a mini disc of the rotor assembly.

14 Claims, 2 Drawing Sheets

SEAL AND LOCKING PLATE FOR TURBINE ROTOR ASSEMBLY BETWEEN TURBINE BLADE AND TURBINE VANE

FIELD OF THE INVENTION

This invention is directed generally to turbine engines, and more particularly to seal plates and locking plates in turbine blade rotor assemblies of turbine engines.

BACKGROUND

In conventional gas turbine engines, a rotor assembly is formed from a plurality of axially spaced rows of turbine blades separated by rows of stationary turbine vanes supported by framework proximate to the shell of the turbine engine. Adjacent rows of turbine blades may be separated by mini discs or other components to maintain the appropriate position of the turbine blades relative to each other. Due to the hot temperatures encountered by the turbine blades during normal turbine engine operation, conventional turbine blades typically include internal cooling systems and film cooling systems that receive cooling fluids from internal channels within the rotor assembly. Cooling fluids may be supplied to the turbine blades from rotor assemblies.

In conventional rotor assemblies, turbine vanes are sealed to the rotor assembly with a plurality of seal plates positioned axially between a row of turbine blades and a row of turbine vanes. The seal plates are supported in position with arms extending from the turbine blades, also referred to as angle wings. Such a configuration often results in stresses in the seal plate that cause seal plate buckling. Seal plate buckling is buckling of the seal plates that occurs when temperatures and local loads are not correctly predicted and designed for during the design process for the seal plates. Thus, a need exists for reducing the risk of seal plate buckling. Additionally, the seal plates may cause locking of the turbine blades because the seal plates bear upon the arms extending from the turbine blades. Blade locking causes turbine blades to fail due to the reduction of damping caused by the increased load applied to the turbine blade arms. Thus, a need exists for reducing the risk of turbine blade locking.

SUMMARY OF THE INVENTION

This invention relates to a seal plate system adapted to fit between axially adjacent rows of turbine blades and turbine vanes. The seal plate system may be formed from a plate adapted to position a turbine blade into position in a rotor assembly and lock the turbine blade into the rotor assembly. The plate may also function to seal a cooling system in the turbine blade. In at least one embodiment, the plate is configured to accomplish both of these tasks together once installed into a mini disc of the rotor assembly.

The plate may be formed from a generally curved body that is curved circumferentially about a longitudinal axis of a turbine rotor assembly. The body may include an engaging surface for contacting a root of a turbine blade to position the turbine blade axially within a turbine rotor assembly and to seal a cooling system in the turbine blade. A seal, such as, but not limited to, a rope seal, may be positioned on the engaging surface to seal the plate to a turbine blade. The plate may also include a connector for attaching the generally curved body to a mini disc within the turbine rotor assembly that is configured to separate axially adjacent rows of turbine blades. An extension arm may extend from the generally curved body for limiting flow of cooling fluids between the turbine blade and an adjacent turbine vane. In at least one embodiment, the extension arm may include a protrusion for reducing the leakage of hot gases from the turbine flow path.

The connector may be formed from any device capable of attaching the seal plate to the rotor assembly or related component. In at least one embodiment, the connector may be formed from at least one dovetail configured to be received within a corresponding cavity in the mini disc. The connector may extend from a first section of the body. A flange may extend from the generally curved body proximate to the connector.

The body of the plate may have a center of mass that is axially off-centered from a radially extending centerline of the connector. In at least one embodiment, the center of mass may be located axially between a centerline of the connector and the engaging surface of the generally radially extending curved body. Such a configuration creates a force directed on the body of the plate while the rotor assembly is rotating during turbine engine operation. The force may be generally orthogonal to the engaging surface and directed from the engaging surface toward the adjacent turbine blade to which the engaging surface contacts. Thus, by positioning the center of mass off-centered from the centerline of the connector, a force is developed during turbine engine operation that directs the body and the engaging surface into the turbine blade, thereby enabling the turbine blade to be sealed and locked in position. The body of the plate may also be generally curved and include a first section to which the connector is attached, a second section extending nonparallel from the first section, generally at an acute angle, and a third section extending from the second section and aligned generally with the first section. The engaging surface may be attached to the third section. The generally curved body may be configured to extend partially around a turbine rotor assembly.

An advantage of the invention is that the plate may be capable of performing at least two functions that had been accomplished separately in conventional designs. More specifically, the plate may be adapted to position and lock a turbine blade into a rotor assembly and to seal a cooling system in the turbine blade. Thus, the plate of the instant invention may perform the functions of conventional seal plates and locking plates.

Another advantage of this invention is that the plate is supported by the rotor assembly, which results in reduced stresses to the plate compared to conventional configurations of seal plates that are supported by arms extending from a turbine blade. Thus, in this invention, the rotor assembly carries the load of the plate, not the arms extending from a turbine blade.

Yet another advantage of this invention is that the plate is easily attachable to or removable from attachment with the mini disc, thereby facilitating easy maintenance of the seal plates.

Another advantage of this invention is that use of the plate eliminates the risk of plate buckling due to the attachment of the plate to the rotor assembly.

Still another advantage of this invention is that because the plate is supported by the rotor assembly and not supported by the turbine blade, the vibrations that the turbine blade undergoes while the turbine engine is operating do not deviate substantially from anticipated, designed for vibrations. As such, the anticipated lifecycle of the turbine blade does not differ substantially from the anticipated, designed for lifecycle and the likelihood of unexpected damage is reduced due to decreased likelihood of blade locking.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
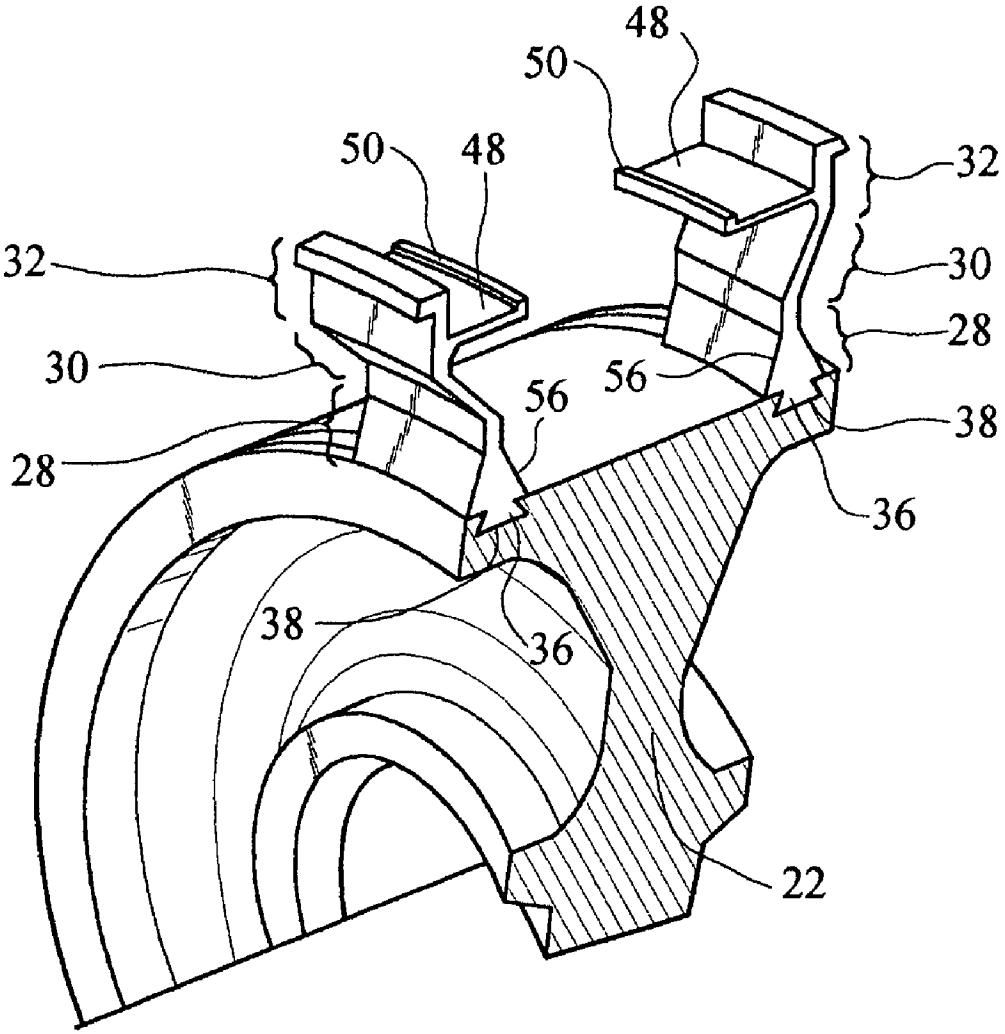
FIG. 1 is a perspective view of plates having features according to the instant invention attached to a mini disc.
Figure 2:
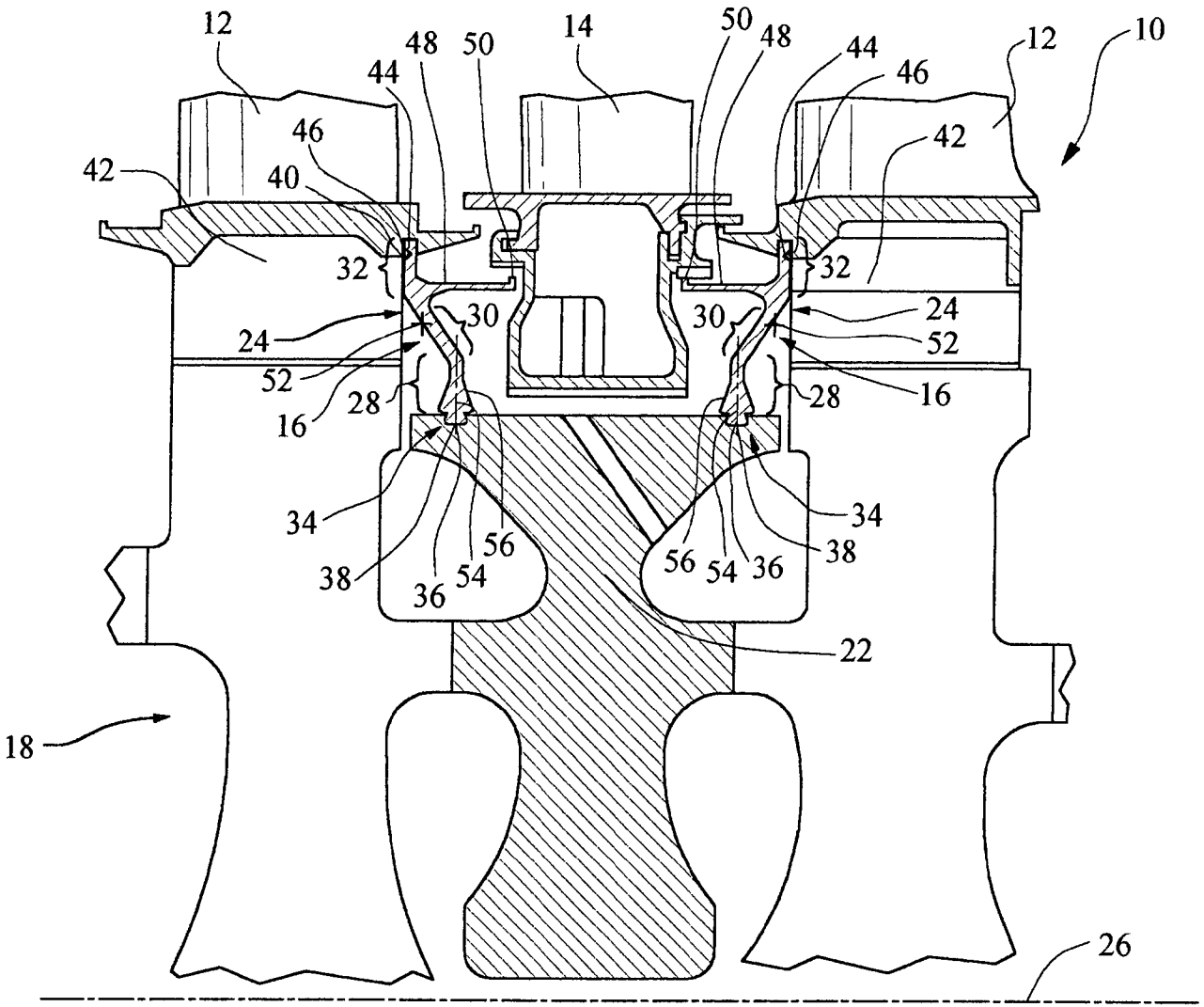
FIG. 2 is cross-sectional view of plates of this invention attached to a mini disc and positioned between axially adjacent rows of turbine blades.

As shown in FIGS. 1-2, this invention is directed to a seal plate system 10 adapted to fit between axially adjacent rows of turbine blades 12 and turbine vanes 14. The seal plate system 10 may be formed from a plate 16 adapted to position a turbine blade 12 in a rotor assembly 18 and lock the turbine blade 12 into the rotor assembly 18. The plate 16 may also function to seal a cooling system in the turbine blade 12. In at least one embodiment, the plate 16 may be configured to accomplish both of these tasks together once installed into a mini disc 22 of the rotor assembly 18.

As shown in FIG. 2, the plate 16 may be formed from a generally curved body 24 that is configured to curve circumferentially (see FIG. 1) about a longitudinal axis 26 of the rotor assembly 18, which is the axis about which the rotor assembly 18 rotates. The generally curved body may be formed from a first section 28, a second section 30 extending from the first section at a generally acute angle, and a third section 32 extending from the second section 30. The body 24 may have alternative configurations as well. The body 24 may be formed from the following materials, such as, but not limited to, IN718, 10325PN, X-12CrMoWVNbB10 or other appropriate materials.

The plate 16 may include a connector 34 configured to secure the plate 16 to the rotor assembly 18. As shown in FIGS. 1 and 2, the connector 34 may be configured to attach the plate 16 to the mini disc 22. The mini disc 22 may be configured to secure and support adjacent turbine blades 12 to provide the proper spacing for the turbine vanes 14. In at least one embodiment, the connector 34 may be formed from a dovetail 36. The dovetail 36 may or may not extend the entire length of the plate 16. The mini disc 22 may include a cavity 38 for receiving and retaining the dovetail 36. In at least one embodiment, the connector 34 may extend from the first section 28 of the body 24. A flange 56 may extend from the generally curved body 24 proximate to the connector 34 for support during periods when the turbine engine in which the plate 16 is mounted is not operating.

The plate 16 may also include an engaging surface 40 that is configured to engage a portion of the turbine blade 12, such as a root 42, to position the turbine blade 12 within the rotor assembly 18 and to lock the turbine blade 12 in position to prevent the turbine blade from inadvertent changes in position. The engaging surface 40 may be positioned on the third section 32 of the body 24. The engaging surface 40 may include a recess 44. In at least one embodiment, a seal 46, such as but not limited to a rope seal, may be positioned in the recess 44 for sealing the turbine blade 12 to the plate 16.

As shown in FIGS. 1 and 2, the plate 16 may also include an extension arm 48 extending from the curved body 16 for limiting the flow of cooling fluids between the turbine blade 12 and the turbine vane 14. The extension arm 48 may include a protrusion 50 for reducing the leakage of hot gases from the turbine flow path.

The body 24 may be configured such that a center of mass 52 is off-centered from a centerline 54 of the first section 28 of the curved body 24. In at least one embodiment, the center of mass 52 of the body 24 may be positioned between the centerline 54 of the first section 28 and the engaging surface 40. Such a configuration creates a force directed on the body 24 of the plate 16 while the rotor assembly 18 is rotating during turbine engine operation. The force is generally orthogonal to the engaging surface 40 and directed from the engaging surface toward the adjacent turbine blade 12 to which the engaging surface contacts. Thus, by positioning the center of mass 52 off-centered from the centerline 54 of the connector 34, a force is developed during turbine engine operation that directs the body 24 and the engaging surface 40 into the turbine blade 12, thereby locking the turbine blade 12 in place.

The plate 16 may extend partially around the rotor assembly 18. Multiple discs 16 may be used to seal a row of turbine blades 12 positioned around a rotor assembly 18. The plates 16 may be any length enabling sufficient sealing of the turbine blades 12 while also being removable from attachment with the rotor assembly 18.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A plate positionable between adjacent turbine blades, comprising:

a generally curved body that is curved circumferentially about a longitudinal axis of a turbine rotor assembly and having an engaging surface for contacting a root of a turbine blade to position the turbine blade axially within the turbine rotor assembly and seal the turbine blade;

a connector tor attaching the generally curved body to the turbine rotor assembly that is configured to separate longitudinal adjacent turbine blades;

wherein the connector is configured to be attached to a mini disk separating longitudinally adjacent turbine blades; and an extension arm extending from the generally curved body for limiting flow of cooling fluids between the turbine blade and an adjacent turbine vane;

wherein the generally curved body comprises a first section to which the connector is attached, a second section extending at an acute angle from the first section and opposite to the connector, and a third section extending from the second section and aligned with the first section, wherein the engaging surface is attached to the third section.

2. The plate of claim 1, wherein the connector comprises at least one dovetail configured to be received within a corresponding cavity in the mini disc.

3. The plate of claim 2, further comprising a flange extending from the generally curved body proximate to the connector.

4. The plate of claim 1, wherein a center of mass of the generally curved body is axially off-centered from a radially extending centerline of the connector.

5. The plate of claim 4, wherein the center of mass of the generally curved body is located axially between the centerline of the connector and the engaging surface of the generally curved body.

6. The plate of claim 1, further comprising a seal positioned on the engaging surface between the engaging surface and an adjacent turbine blade.

7. The plate of claim 1, wherein the extension arm includes a protrusion adapted to reduce leakage of hot gases from a turbine flow path.

8. The plate of claim 1, wherein the generally curved body is configured to extend partially around the turbine rotor assembly.

9. A turbine assembly, comprising:

a plate formed from a generally curved body that is curved circumferentially about a longitudinal axis of a turbine rotor assembly and having an engaging surface contacting a root of a turbine blade to position the turbine blade axially within the turbine rotor assembly and seal the turbine blade;

a connector attaching the generally curved body to a mini disc separating longitudinally adjacent turbine blades;

wherein the generally curved body comprises a first section to which the connector is attached, a second section extending at an acute angle from the first section and opposite to the connector, and a third section extending from the second section and aligned with the first section, wherein the engaging surface is attached to the third section;

an extension arm extending from the generally curved body for limiting flow of cooling fluids between the turbine blade and an adjacent turbine vane;

wherein a center of mass of the generally curved body is located axially between a centerline of the connector and the engaging surface of the generally curved body.

10. The turbine assembly of claim 9, wherein the connector comprises at least one dovetail configured to be received within a corresponding cavity in the mini disc.

11. The turbine assembly of claim 10, further comprising a flange extending from the generally curved body proximate to the connector.

12. The turbine assembly of claim 9, further comprising a seal positioned on the engaging surface.

13. The turbine assembly of claim 9, wherein the extension arm includes a protrusion adapted to reduce leakage of hot gases from a turbine flow path.

14. The turbine assembly of claim 9, wherein the generally curved body is configured to extend partially around the turbine rotor assembly.

* * * * *